US006454663B1

(12) United States Patent
Bakke

(10) Patent No.: US 6,454,663 B1
(45) Date of Patent: Sep. 24, 2002

(54) GOLF CLUB HEAD

(75) Inventor: Jan Bakke, Holmestrand (NO)

(73) Assignee: MGolf International AS, Holmestrand (NO)

( * ) Notice: Subject to any disclaimer, the term of this patent is extended or adjusted under 35 U.S.C. 154(b) by 0 days.

(21) Appl. No.: 09/549,819

(22) Filed: Apr. 14, 2000

(30) Foreign Application Priority Data

Mar. 28, 2000 (NO) ..... 2000 1615

(51) Int. Cl.[7] ..... A63B 53/04
(52) U.S. Cl. ..... 473/328
(58) Field of Search ..... 473/324, 328, 473/350, 290, 291, 344, 349, 327; D21/747, 752

(56) References Cited

U.S. PATENT DOCUMENTS

| | | | | |
|---|---|---|---|---|
| 1,541,126 A | | 6/1925 | Dunn | |
| 2,550,846 A | * | 5/1951 | Milligan | |
| 3,138,386 A | | 6/1964 | Onions | 273/167 |
| 3,810,631 A | | 5/1974 | Braly | 273/167 |
| 4,065,133 A | * | 12/1977 | Gordos | |
| 4,869,507 A | * | 9/1989 | Sahm | |
| 5,419,556 A | * | 5/1995 | Take | |
| 5,433,440 A | * | 7/1995 | Lin | |
| 5,665,012 A | * | 9/1997 | Bunn | |
| 5,674,132 A | * | 10/1997 | Fisher | |
| 5,851,159 A | | 12/1998 | Burrows | 473/345 |
| 6,015,354 A | * | 1/2000 | Ahn | |
| 6,120,389 A | * | 9/2000 | Kruse | |

FOREIGN PATENT DOCUMENTS

| | | | | |
|---|---|---|---|---|
| GB | 340579 | * | 1/1931 | 273/167 A |
| GB | 441593 | * | 1/1936 | 273/167 A |

* cited by examiner

*Primary Examiner*—Sebastiano Passaniti
(74) *Attorney, Agent, or Firm*—Ladas & Parry

(57) ABSTRACT

An iron or wedge golf club head (1) has a hitting surface (2) on a front area, a shaft connection (3) on one side (4), a back area (5) and a bottom surface (6) between the front area and a back edge (8) of the bottom surface in relation to the hitting surface and shaft connection. Only one center area of the bottom surface (6) has a curved recessed area (9) that increases evenly in depth towards the front area only from an area (10) inside the back edge (8) of the bottom surface.

14 Claims, 2 Drawing Sheets

GOLF CLUB HEAD

BACKGROUND OF THE INVENTION

This invention is concerned with a golf club head of "Iron and Wedges" type, with a striking surface on the face, a shaft connection on one of the sides in relation to the striking surface, a back area and a bottom surface/sole between the face and the back area.

There are today many golf clubs, or to be more precise, golf club heads of the type mentioned above. What characterises these known club heads is that they have a flat or rounded shaped sole. These club heads have a bottom surface or sole shape that results in relatively large areas being exposed to the ground during the strike. This will obviously result in great friction resistance between the club's sole and the ground, which again results in part of the force of the strike being lost in the form of friction against the ground.

SUMMARY OF THE INVENTION

One object of the present invention is therefore to eliminate or at least reduce this loss in friction as much as possible, so that as much force as possible is transferred to the golf ball, thus increasing the length of the strike correspondingly.

Another object of the present invention is that a player should be able to achieve best possible control during the performance of a hit under varying conditions. I.e. that the golf club head must be turned as little as possible, when the head hits the ball. This will result in the golf ball achieving a more optimal trajectory.

The present invention shall solve these problems associated with the known golf club heads, and furthermore achieve amongst others the objects described above.

This is achieve according to the invention by a golf club head as mentioned in the introduction of the description and that is recognised by that the bottom surface within a centre area is arranged with a recess in the shape of an cuved lowered area that increases evenly in depth from an area inside the back edge of the bottom surface and towards the front edge of the bottom surface.

The preferred embodiments of the invention are described more thoroughly in the claims 2 to 6.

BRIEF DESCRIPTION OF THE SEVERAL VIEWS OF THE DRAWING

The embodiments of the golf club head according to the present invention will now be explained with reference to figures, wherein.

DETAILED DESCRIPTION OF THE EMBODIMENTS

Figure 1:
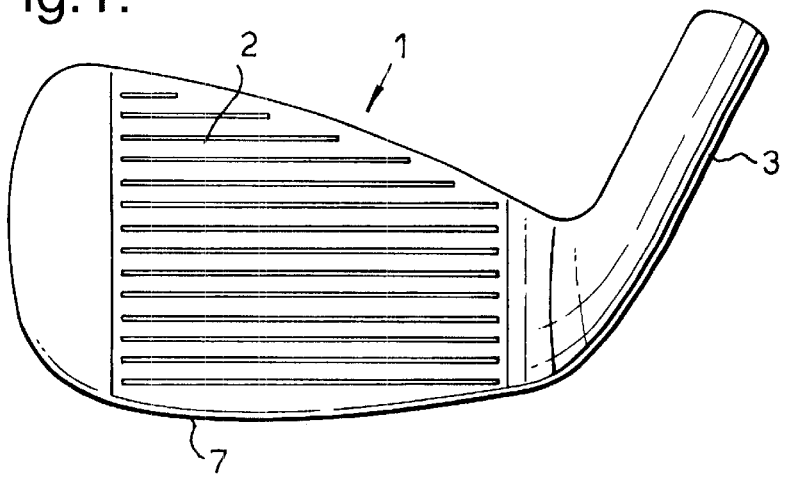
FIG. 1 shows a golf club head according to the present invention showing the hitting surface and with the shaft connection pointing upwards and to the right.
Figure 2:
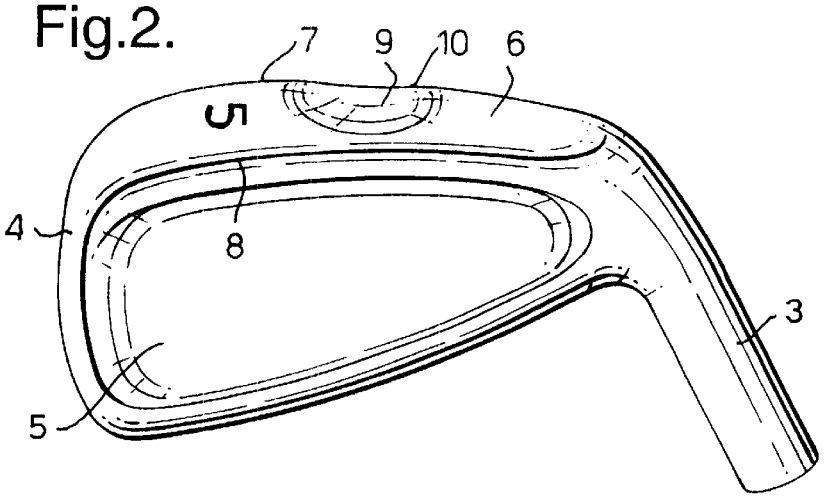
FIG. 2 shows the golf club head in FIG. 1 seen from the back area and with the shaft connection pointing downwards and to the right.
Figure 3:
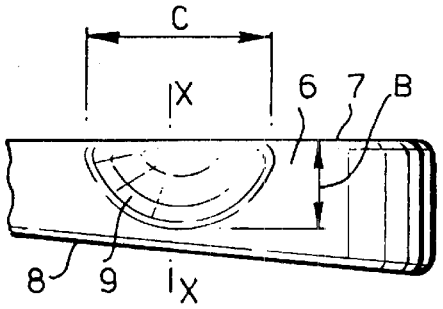
FIG. 3 shows a schematic diagram of the bottom surface of the club head in FIG. 2.
Figure 4:
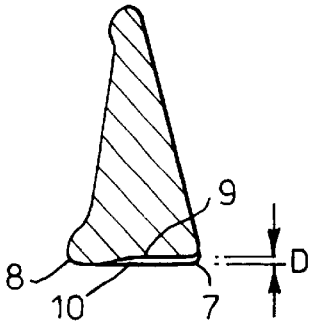
FIG. 4 shows a cross section through section X—X in FIG. 3.

Referring first to FIG. 1, a front area or a hitting surface 2 of a golf club head 1 is shown. The golf club head 1 has a mainly flat hitting surface 2 and is further arranged with a shaft connection 3 pointing to the right hand in the Figure. FIG. 2 shows a back area 5 of the golf club head 1 in FIG. 1. The shaft connection 3 is here shown pointing downwards to the right. The golf club head 1 has furthermore a bottom surface or sole 6 and a side surface 4. The bottom surface 6 and the side surface 4 are rounded. The bottom surface 6 is further arranged with a grove in, the shape of a rounded lowered area 9. The lowered area 9 is arranged in a centre area of the bottom surface 6 that will be below the hitting surface's hitting point on the ball. The lowered area 9 has an evenly increasing depth from an area 10 inside the bottom surface's back edge 8 and towards the bottom area's front edge 7. The bottom area's front edge 7, seen from the front towards the hitting surface in FIG. 1, will however not include this lowered area 9. The grove starts just inside the bottom surface's front edge 7. This is shown more clearly in FIG. 4 where the lowered area 9 stretches from an area 10 inside the bottom surface's back edge 8 and finishes inside the bottom surface's front edge 7. The lowered area 9 will have a maximum depth D against the front edge 7. Depth D will vary depending on the club head's application and design, which will be explained later in the description. The depth will normally lie in the range 0.5 to 2.5 mm. The lowered area 9 has moreover an even, rounded and concave curvature. The area of the lowered part 9 can be described as a circle or elliptical shaped sector having approximate diameter C along and inside the bottom surface's front edge 7 and with height B from the grove's finish at the front edge 7 and to the area 10 inside the bottom surface's back edge 8. Diameter C will vary from 10 to 50 mm depending on the club head type as mentioned above. Height B of the lowered area will vary from 0.5 to 30 mm depending on the club type. FIG. 3 shows the lowered area 9 in the bottom surface 6 with specification of the diameter C and the height B.

The design of the club heads according to the present invention will vary, as previously mentioned, with regards to the application. For golf club heads of type "Iron and Wedges" the club head's shape, weight etc. will depend on the classification in accordance with the following numbering system which is standard in the field in question: #1, #2, #3, #4, #5, #6, #7, #8, #9, #SW, LP, PW, AW.

Figure 5:
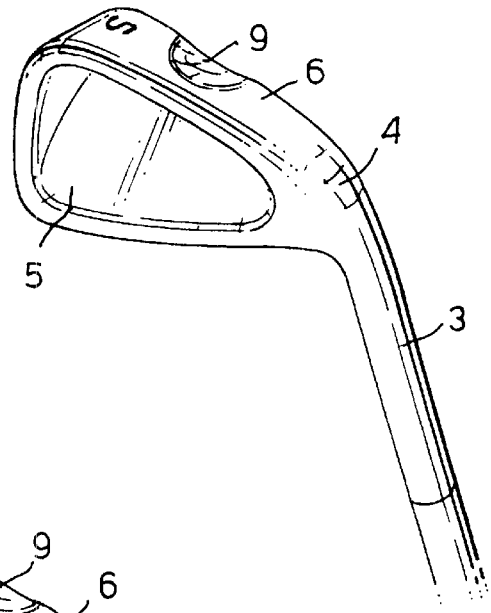
FIG. 5 shows a first embodiment of the club head according to the present invention.
Figure 6:
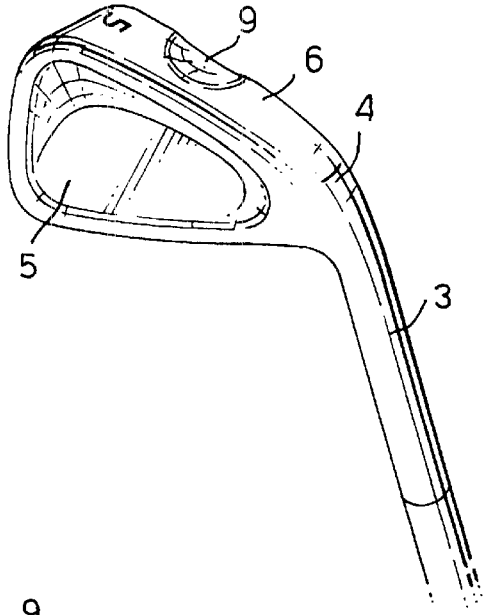
FIG. 6 shows a second embodiment of the club head according to the present invention.
Figure 7:
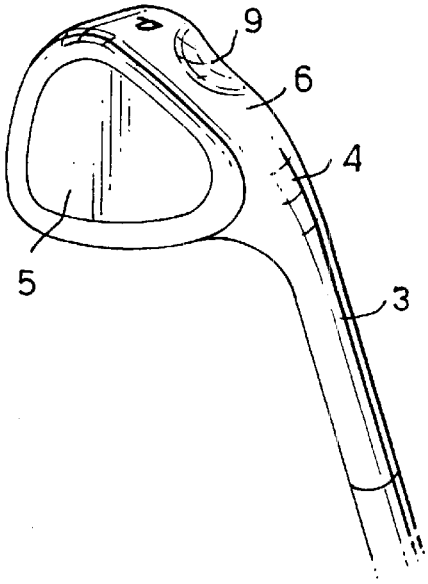
FIG. 7 shows a third embodiment of the golf club head according to the present invention.

FIGS. 5 and 6 show the principles of the present invention applied to club heads of "Iron-" type and more precisely of the "Classic-" type and "Tour-" type, respectively. FIG. 7 shows the principles applied to a club head of the "Wedge-" type. It should be noted that in FIGS. 5, 6 and 7 the same reference numbers for the same parts are used as in the preceding drawings 1 to 4, inclusive.

The inventor of the present invention has, during the development of the golf club head, carried out extensive studies, for example, with regards to the time the ball is in contact with the club head. Depending on the type of golf club head, as described earlier, this contact time will normally vary from 0.4 to 2.0 ms. The shape of the club head according to the present invention, especially with regards to the grove in the sole, will give soil and grass the possibility to "settle" or disappear in the mentioned milliseconds during ball contact and before the club head starts to dig itself into the ground. Due to the special sole shape, the club head will give the player better stability during the performance of a hit, reduce the club head's turning and create a more optimal ball trajectory. Hits that have initially more or less failed, will, with the invented club head, still possibly give a satisfactory result. The club head shape according to the present invention will help raise the ball quickly with "Long Irons", and give the ball a more forceful trajectory with "Low Irons". The result is that the golf club heads according to the present invention will give the player significantly better control during the performance of a hit, and thus a significantly improved result will be achieved, compared to what would be achieved with existing golf club heads of this type.

What is claimed is:

1. In an iron or wedge golf club head (1) having a hitting surface (2) on a front area, a shaft connection (3) on one side (4), a back area (5) and a bottom surface (6) between the front area and a back edge (8) of the bottom surface in relation to the hitting surface and shaft connection, the improvements wherein only one center area of only the bottom surface (6) has a curved recessed area (9) that increases evenly in depth towards the front area only from an area (10) inside the back edge (8) of the bottom surface.

2. Golf club head (1) as described in claim 1, wherein the recessed area (9) increases in width towards the front area.

3. Golf club head (1) as described in claim 2, wherein the recessed area (9) has an even, curved, concave arch and exhibits a maximum depth (D) towards the front area of 0.5 to 2.5 mm.

4. Golf head (1) as described in claim 3, wherein the outer periphery of the recessed area (9) describes a circle or elliptical shaped sector with approximate diameter (C) along an inside of the front area with height (B) towards the area.

5. Golf club head (1) as described in claim 4, wherein the diameter (C) is 10 to 50 mm.

6. Golf club head (1) as described in claim 4, wherein the height (B) is 0.5 to 30 mm.

7. Golf club head (1) as described in claim 2, wherein the outer periphery of the recessed area (9) describes a circle or elliptical shaped sector with an approximate diameter (C) along an inside of the front area with a height (B) towards the area (10).

8. Golf club head (1) as described in claim 1, wherein the recessed area (9) has an even, curved, concave arch and exhibits a maximum depth (D) towards the front area of 0.5 to 2.5 mm.

9. Golf club head (1) as described in claim 8, wherein the outer periphery of the recessed area (9) describes a circle or elliptical shaped sector with approximate diameter (C) along an inside of the front area with height (B) towards the area (10).

10. Golf club head (1) as described in claim 9, wherein the diameter (C) is 10 to 50 mm.

11. Golf club head (1) as described in claim 9, wherein the height (B) is 0.5 to 30 mm.

12. Golf club head (1) as described in claim 1, wherein the outer periphery of the recessed area (9) describes a circle or elliptical shaped sector with an approximate diameter (C) along an inside of the front area with a height (B) towards the area (10).

13. Golf club head (1) as described in claim 12, wherein the diameter (C) is 10 to 50 mm.

14. Golf club head (1) as described in claim 12, wherein the height (B) is 0.5 to 30 mm.

* * * * *